US005237794A

United States Patent [19]

Ballestrazzi et al.

[11] Patent Number: 5,237,794

[45] Date of Patent: Aug. 24, 1993

[54] APPARATUS FOR SEALING PACKAGING PAPER OR THE LIKE WITH ADHESIVE MATERIAL IN A PACKAGING MACHINE FOR EDITORIAL GRAPHIC PRODUCTS

[75] Inventors: Aris Ballestrazzi; Lamberto Tassi, both of Savignano Sul Panaro, Italy

[73] Assignee: Sitmas S.p.A., Spilamberto, Italy

[21] Appl. No.: 920,847

[22] Filed: Jul. 28, 1992

[30] Foreign Application Priority Data

Aug. 5, 1991 [IT] Italy ..... MI91-A/002204

[51] Int. Cl.[5] ..... B65B 11/10; B65B 57/00

[52] U.S. Cl. ..... 53/64; 53/51; 53/550; 493/333

[58] Field of Search ..... 53/450, 550, 548, 64, 53/52, 51; 493/333, 337, 336, 266

[56] References Cited

U.S. PATENT DOCUMENTS

| | | | |
|---|---|---|---|
| 2,070,205 | 2/1937 | Heywood | 493/333 |
| 2,525,651 | 10/1950 | Clunan | 53/450 X |
| 2,615,422 | 10/1952 | Ackley et al. | 118/221 |
| 2,996,854 | 8/1961 | Aronson | 53/51 X |
| 3,245,680 | 4/1966 | Harrison et al. | 270/93 |
| 3,593,485 | 7/1971 | Stovall . | |
| 4,602,741 | 7/1986 | Faulkner, III et al. | 239/135 |

FOREIGN PATENT DOCUMENTS 473190 1/1915 France .

*Primary Examiner*—James F. Coan

*Attorney, Agent, or Firm*—Oblon, Spivak, McClelland, Maier & Neustadt

[57] ABSTRACT

An apparatus for sealing a continuous web of packaging paper or like material with adhesive material in a packaging machine for editorial graphic products, comprising a frame containing a first conveyor for conveying the paper web, unwound from a roll by an unwinding unit, and with the front end of which there are associated, externally, a second conveyor for feeding editorial graphic products to be packaged and, internally, means for folding the web for superimposing its longitudinal edges, there being provided downstream of the sealing apparatus an element for transversely cutting individual finished packages which have been sealed. In a region between the roll and the folding means there is provided an element for dispensing adhesive material in a direction transverse to the web, the dispensing element being operated by means which sense the arrival of each product.

5 Claims, 3 Drawing Sheets

13
14
16
17
18
19
20
22
23
24
25
26
27
28
29
30
31
32
33
34
35

APPARATUS FOR SEALING PACKAGING PAPER OR THE LIKE WITH ADHESIVE MATERIAL IN A PACKAGING MACHINE FOR EDITORIAL GRAPHIC PRODUCTS

This invention relates to an apparatus for sealing packaging paper or the like with adhesive material in a packaging machine for editorial graphic products.

For packaging editorial graphic products, continuous plastic film such as propylene or polyethylene is normally used, resulting in low overall cost because the handling and welding equipment used is very reliable and fast.

Because of the difficulties involved in the disposal and degradation of these plastics without causing environmental pollution, there is an ever increasing requirement for using quickly degradable packaging material such as paper or the like. However, with these materials considerable problems arise in the handling of an individual editorial product or group of products and their stable positioning within the finished package.

A particular problem arises in forming the finished package, as no apparatus has as yet been conceived which is able to seal the product to be packaged, or close it against the external environment, within the continuous paper material, which originates for example from a preformed roll.

The object of the present invention is to provide an apparatus able to suitably seal the paper around the product in such a manner as to satisfy market requirements, current postal requirements and those services responsible for delivering such packages to the user.

This object is attained according to the present invention by an apparatus for sealing a continuous web of packaging paper or like material with adhesive material in a packaging machine for editorial graphic products, comprising a frame containing a first conveyor for conveying said continuous paper web, unwound from a roll by an unwinding unit, and with the front end of which there are associated, externally, a second conveyor for feeding editorial graphic products to be packaged and, internally, means for folding said web for superimposing its longitudinal edges, downstream of said sealing apparatus there being provided an element for transversely cutting individual finished packages which have been sealed, characterised in that in a region between said roll and said folding means there is provided an element for dispensing adhesive material in a direction transverse to said web, said dispensing element being operated by means which sense the arrival of each product fed by said second conveyor.

Preferably, there is also provided at said front end a second element for dispensing adhesive material onto that surface of at least one of said longitudinal edges of said paper web which is to be turned over to face the other edge in forming the finished package.

The advantages and the technical and constructional characteristics of the apparatus according to the present invention will be more apparent from the following description given with reference to the accompanying schematic drawings, in which.

Figure 1:
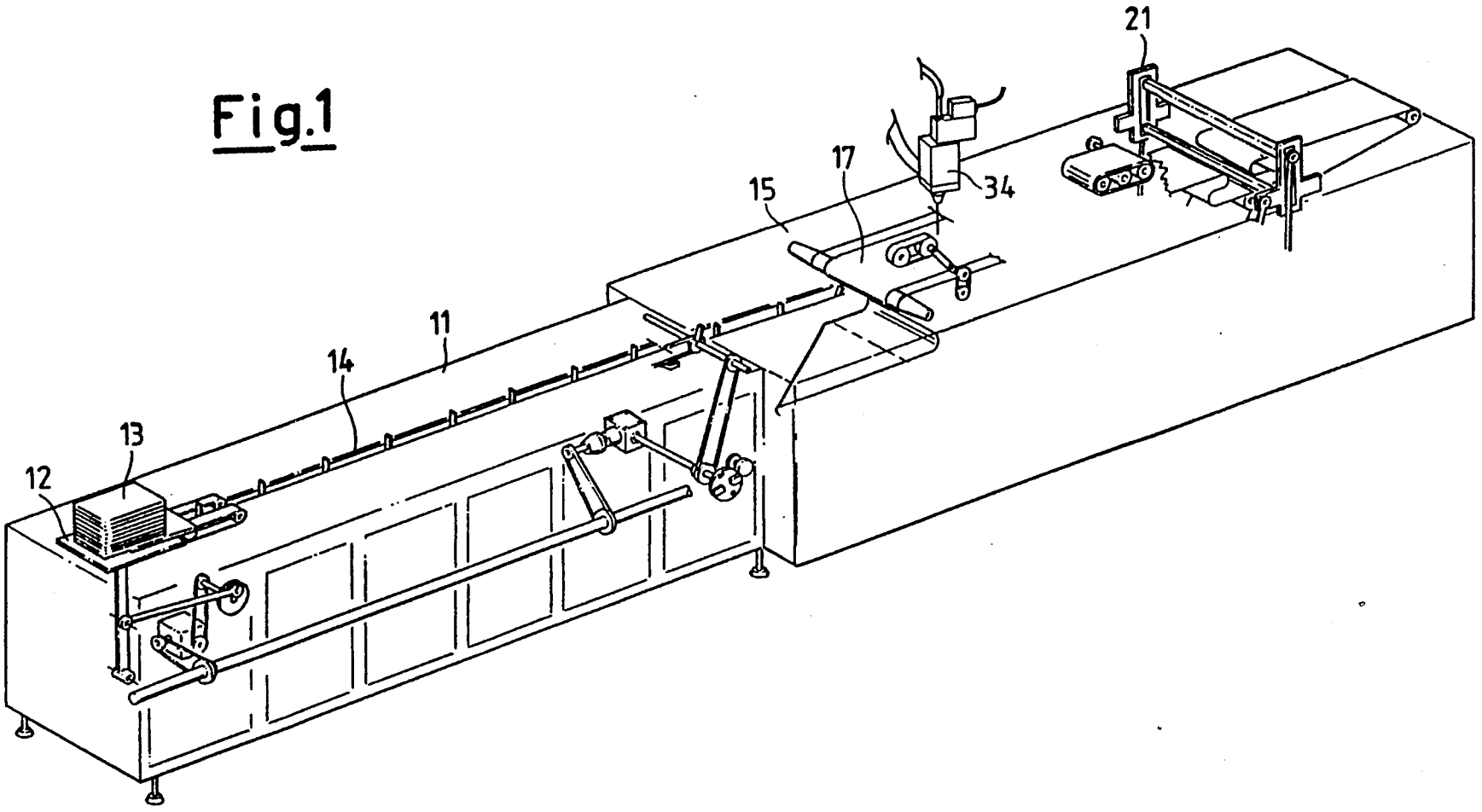
FIG. 1 is a perspective view of a machine for packaging editorial graphic products in paper or like material provided with an apparatus for sealing said material, in accordance with the present invention.

With reference to the figures, an apparatus for sealing with adhesive material a continuous web of paper or similar material for packaging editorial graphic products according to the invention is shown mounted on a packaging machine for such products.

This packaging machine comprises essentially a general structure 11 on which a feeder 12 is positioned for stacked editorial graphic products 13 to be fed to a conveyor 14 of pusher type. Downstream of the conveyor 14 there is positioned the apparatus of the present invention, which comprises a frame 15 containing a belt conveyor 16 for receiving a continuous paper web 17 which is unwound from a roll 18 by an unwinding unit 19, shown schematically as a two-cylinder calender. With the front end of the conveyor 16 there are associated, externally, the feed conveyor 14 for the editorial graphic products 13 to be packaged and, internally, folding means or deviators (not shown) for the paper web, which cooperate in the superposing of its longitudinal edges 20.

Downstream of the sealing apparatus according to the invention there is provided a transverse cutting element shown schematically at 21, for example comprising a transverse blade which by moving vertically with reciprocating motion separates the individual packages defined by the adhesive material, these being finished and perfectly sealed.

In a region between the paper roll 18 and the folding means, the sealing apparatus according to the invention comprises an adhesive material dispensing element, indicated overall by 22, which dispenses the adhesive material in a direction essentially transverse to said paper web 17.

In the illustrated embodiment, the dispensing element 22 consists of a roller 23 which via a second roller 24 withdraws adhesive material 25 contained in a tank 26 provided with heating means, such as electrical resistance elements 27 fitted to it. A doctor blade 28 selects and regulates the quantity of adhesive 25 to be used before the adhesive material is transferred from the roller 24 to the roller 23. Preferably on the first roller 23 there is provided a transverse pad 29 which receives the adhesive and deposits it on the paper web 17 in transverse lines 30. The transverse pad 29 comprises two spaced transverse parallel teeth which hence deposit two continuous lines of adhesive, between which the transverse cutting blade 21 acts.

The phasing of the rollers 23 and 24 is controlled by a friction brake unit 31 governed for example by sensor means 32 which sense the arrival of each product fed by the second conveyor 14. In the example the sensor 32 is a photoelectric cell which senses the rotation of the chain 33 which rotates the conveyor 14.

A second dispensing element of roller type, similar to the first, could also be provided at said front end of the first conveyor 16, to deposit the adhesive material longitudinally along that surface of at least one of said longitudinal edges 20 of the paper web 17 which is to be turned over to face the other edge in forming the finished package.

The adhesive material can hence be kept hot and used for gluing the superimposed edges of the paper web under the best possible conditions. The adhesive material can be a hot melt or any other similar product.

In the illustrated embodiment, this second dispensing element, indicated by 34, is of the dispensing gun type, which operates on command in relation to the advancement of the paper web 17. For this purpose second sensor means 35 can for example be used, to control the correct unwinding of the paper web 17 and also control the dispensing gun 34, by halting it, regulating the quantity to be dispensed, etc.

Figure 4:
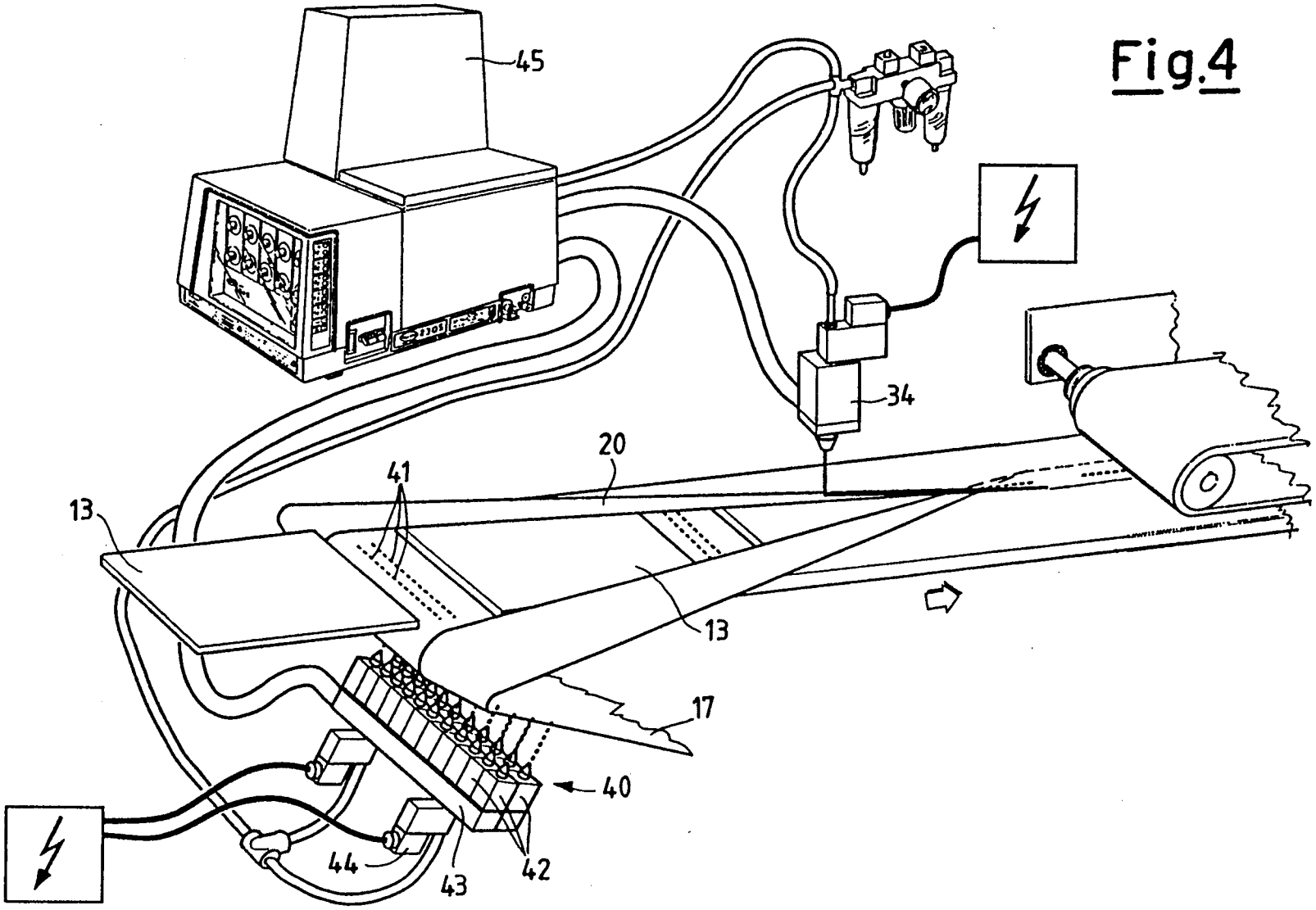
FIG. 4 is a perspective view of a second embodiment of an apparatus according to the invention.

The sealing apparatus according to the invention, positioned in the region between the paper roll 18 and the folding means, can alternatively consist of a special adhesive material dispensing element, indicated overall in FIG. 4 by 40, which dispenses a plurality or rows of spots 41 of adhesive material in a direction essentially transverse to said paper web 17 as it unwinds and advances.

In the illustrated embodiment the dispensing element 40 consists of a bank of guns 42 associated with each other on a support 43 and connected to relative solenoid valves 44. The solenoid valves 44 are connected to a central control unit 45 by which the pattern of the spots 41 obtainable on the paper web 17 can be varied in terms of their mutual positioning, and the size of the individual spot 41 can be varied by increasing or decreasing the quantity of adhesive material dispensed.

The element for dispensing the longitudinal continuous line of adhesive material, indicated by 34, can again in this case be of the dispensing gun type operating on command in relation to the advancement of the paper web 17. In the illustrated embodiment the dispensing element 34 is also connected to the central control unit 45, which provides directly for halting it, for adjusting the quantity dispensed along the longitudinal edges 20 of the paper web 17, etc.

Figures 2, 3:
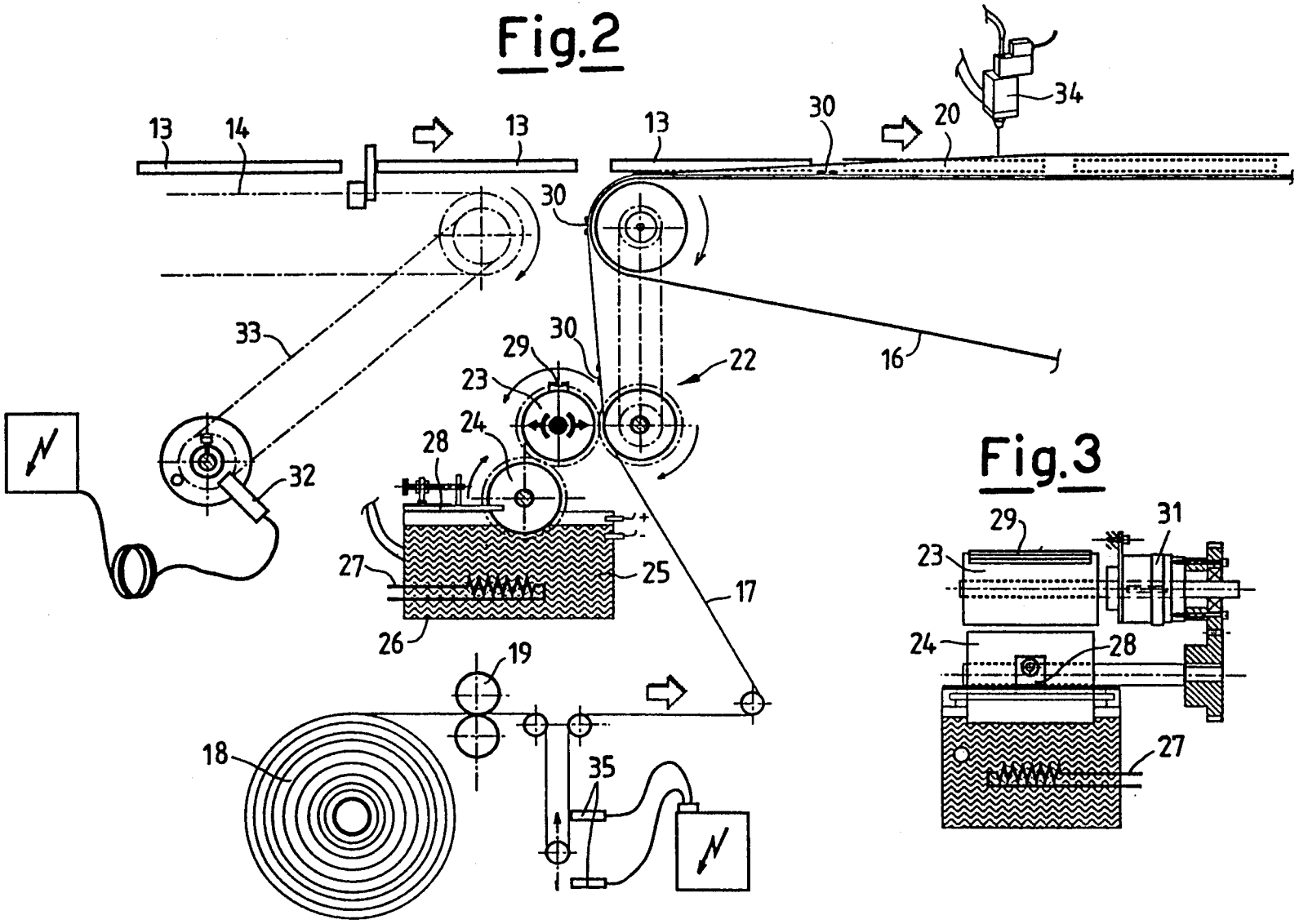
FIG. 2 is an elevational view of a first embodiment of an apparatus according to the present invention.
FIG. 3 is a transverse detail of the element for dispensing adhesive material transversely to the paper web.

By means of suitable sensors, such as the sensors 35 of FIG. 2 or the like, which measure the length of the product being fed by the conveyor 14, the central control unit 45 sets the dispensing times and the appropriate interval between them. In this manner the lines of spots 41 are arranged on the paper web 17 in proximity to the ends of the product 13 to be packaged, as is clear from FIG. 4.

In a packaging machine provided with the apparatus according to the invention it is hence possible to package editorial graphic products within a material in paper web or similar form, while solving all the problems connected with current requirements. Specifically, the package can be provided with transverse adhesive lines or spots at its front and rear ends by the transverse dispensing element 22 or 40. In an alternative embodiment, a further longitudinal adhesive line can be provided, which need not be continuous but can be in portions of predetermined length.

This is made possible by a timer which determines the positioning or dispensing of the adhesive by the longitudinal dispensing element according to requirements, for a repetitive limited time or not. Inspection apertures for delivery officials can be created in this manner.

With both the described types of dispensing element at least one continuous line of adhesive material is formed, to ensure optimum sealing of the package.

We claim:

1. An apparatus for sealing a continuous web of packaging paper or like material with adhesive material in a packaging machine for editorial graphic products, comprising a frame containing a first conveyor for conveying said continuous paper web, unwound from a roll by an unwinding unit, and with the front end of which there are associated, externally, a second conveyor for feeding editorial graphic products to be packaged and, internally, means for folding said web for superimposing its longitudinal edges, there being provided downstream of said sealing apparatus an element for transversely cutting individual finished packages which have been sealed, characterized in that in a region between said roll and said folding means there is provided an element for dispensing adhesive material in a direction transverse to said web, said dispensing element being operated by means which sense the arrival of each product fed by said second conveyor wherein said dispensing element comprises a first roller in contact with said paper web and, via a second roller, withdrawing adhesive material contained in a tank provided with heating means, with said second roller there being associated a doctor blade which selects and regulates the quantity of adhesive to be used before said adhesive material is transferred from one to the other roller and wherein on said first roller there is provided a transverse pad which receives said adhesive material and deposits it on said paper web in the form of transverse lines.

2. An apparatus as claimed in claim 1, characterised in that on said pad of said first roller there are provided two transverse spaced parallel teeth which hence deposit two continuous lines of adhesive material.

3. An apparatus for sealing a continuous web of packaging paper or like material with adhesive material in a packaging machine for editorial graphic products, comprising a frame containing a first conveyor for conveying said continuous paper web, unwound from a roll by an unwinding unit, and with the front end of which there are associated, externally, a second conveyor for feeding editorial graphic products to be packaged and, internally, means for folding said web for superimposing its longitudinal edges, there being provided downstream of said sealing apparatus an element for transversely cutting individual finished packages which have been sealed, characterized in that in a region between said roll and said folding means there is provided an element for dispensing adhesive material in a direction transverse to said web, said dispensing element being operated by means which sense the arrival of each product fed by said second conveyor wherein said dispensing element comprises a first roller in contact with said paper web and, via a second roller, withdrawing adhesive material contained in a tank provided with heating means, with said second roller there being associated a doctor blade which selects and regulates the quantity of adhesive to be used before said adhesive material is transferred from one to the other roller and wherein the phasing of said two rollers is controlled by a friction brake unit governed by sensor means which sense the arrival of each product fed externally by said second conveyor.

4. An apparatus for sealing a continuous web of packaging paper or like material with adhesive material in a packaging machine for editorial graphic products, comprising a frame containing a first conveyor for conveying said continuous paper web, unwound from a roll by an unwinding unit, and with the front end of which there are associated, externally, a second conveyor for feeding editorial graphic products to be packaged and, internally, means for folding said web for superimposing its longitudinal edges, there being provided downstream of said sealing apparatus an element for transversely cutting individual finished packages which have been sealed, characterized in that in a region between said roll and said folding means there is provided an element for dispensing adhesive material in a direction transverse to said web, said dispensing element being operated by means which sense the arrival of each product fed by said second conveyor wherein said dispensing element comprises a first roller in contact with said paper web and, via a second roller, withdrawing adhesive material contained in a tank provided with heating means, with said second roller there being associated a doctor blade which selects and regulates the quantity of adhesive to be used before said adhesive material is transferred from one to the other roller and wherein said sensor means are a photoelectric cell which senses the rotation of a chain which rotates said second conveyor.

5. An apparatus for sealing a continuous web of packaging paper or like material with adhesive material in a packaging machine for editorial graphic products, comprising a frame containing a first conveyor for conveying said continuous paper web, unwound from a roll by an unwinding unit, and with the front end of which there are associated, externally, a second conveyor for feeding editorial graphic products to be packaged and, internally, means for folding said web for superimposing its longitudinal edges, there being provided downstream of said sealing apparatus an element for transversely cutting individual finished packages which have been sealed, characterized in that in a region between said roll and said folding means there is provided an element for dispensing adhesive material in a direction transverse to said web, said dispensing element being operated by means which sense the arrival of each product fed by said second conveyor wherein at said front end there is also provided a second element for dispensing adhesive material onto that surface of at least one of said longitudinal edges of said paper web which is to be turned over to face the other edge in forming the finished package and wherein means for timing the dispensing of adhesive material are associated with said second dispensing element.

* * * * *

UNITED STATES PATENT AND TRADEMARK OFFICE

CERTIFICATE OF CORRECTION

PATENT NO. : 5,237,794

DATED : August 24, 1993

INVENTOR(S) : Aris Ballestrazzi et al.

It is certified that error appears in the above-indentified patent and that said Letters Patent is hereby corrected as shown below:

On the title page, Item [73],

The assignee, should read: --Sitma S.p.A., Spilamberto, Italy--

Signed and Sealed this

Twenty-ninth Day of March, 1994

*Attest:*

Bruce Lehman

BRUCE LEHMAN

*Attesting Officer*

*Commissioner of Patents and Trademarks*